US010400347B2

(12) United States Patent
Nishikawa et al.

(10) Patent No.: US 10,400,347 B2
(45) Date of Patent: Sep. 3, 2019

(54) CONDUCTIVE MEMBER, AND PRODUCTION METHOD THEREFOR

(71) Applicant: NIPPON LIGHT METAL COMPANY, LTD., Tokyo (JP)

(72) Inventors: Yosuke Nishikawa, Shizuoka (JP); Sayuri Shimizu, Shizuoka (JP); Shinichiro Sumi, Shizuoka (JP)

(73) Assignee: NIPPON LIGHT METAL COMPANY, LTD., Tokyo (JP)

( * ) Notice: Subject to any disclaimer, the term of this patent is extended or adjusted under 35 U.S.C. 154(b) by 0 days.

(21) Appl. No.: 15/763,684

(22) PCT Filed: Aug. 5, 2016

(86) PCT No.: PCT/JP2016/073138
§ 371 (c)(1),
(2) Date: Mar. 27, 2018

(87) PCT Pub. No.: WO2017/056731
PCT Pub. Date: Apr. 6, 2017

(65) Prior Publication Data

US 2018/0298510 A1 Oct. 18, 2018

(30) Foreign Application Priority Data

Sep. 28, 2015 (JP) ..... 2015-189948

(51) Int. Cl.
*H01B 1/00* (2006.01)
*C25D 3/12* (2006.01)
(Continued)

(52) U.S. Cl.
CPC ..... *C25D 3/12* (2013.01); *C25D 5/16* (2013.01); *C25D 7/00* (2013.01); *H01R 4/58* (2013.01);
(Continued)

(58) Field of Classification Search
CPC ..... H01B 1/00
(Continued)

(56) References Cited

U.S. PATENT DOCUMENTS 4,108,740 A * 8/1978 Wearmouth ..... C25D 3/562 101/348
2015/0357723 A1* 12/2015 Tachibana ..... C25D 7/00 439/878

FOREIGN PATENT DOCUMENTS

EP 1480270 A2 11/2004
EP 2993257 A1 3/2016
(Continued)

OTHER PUBLICATIONS

International Search Report for PCT/JP2016/073138, dated Sep. 6, 2016, pp. 1-3 (including English translation).
(Continued)

*Primary Examiner* — Chau N Nguyen
(74) *Attorney, Agent, or Firm* — Pearne & Gordon LLP

(57) ABSTRACT

To provide a conductive member capable of suppressing an increase in contact resistance, and a production method therefor. To solve the problem by providing a conductive member having a Ni plating layer 3 on the surface of contact parts 2 provided on a substrate 1, an arithmetic average roughness Sa of the surface of the Ni plating layer 3 being 20 nm or more. In the Ni plating layer 3, the full width half maximum of a peak at the position of a Ni (200) plane in an x-ray diffraction diagram is preferably 0.6 or less, and an indentation hardness $H_{IT}$ of the Ni plating layer 3 is preferably 5000 n/mm$^2$ or less.

9 Claims, 7 Drawing Sheets

(51) Int. Cl.

| | |
|---|---|
| ***C25D 5/16*** | (2006.01) |
| ***C25D 7/00*** | (2006.01) |
| ***H01R 13/03*** | (2006.01) |
| ***H01R 43/16*** | (2006.01) |
| ***H01R 4/58*** | (2006.01) |
| *H01R 4/70* | (2006.01) |

(52) U.S. Cl.
CPC ..... *H01R 13/03* (2013.01); *H01R 43/16* (2013.01); *H01R 4/70* (2013.01)

(58) Field of Classification Search
USPC ..... 174/126.2
See application file for complete search history.

(56) References Cited

FOREIGN PATENT DOCUMENTS

| | | | | |
|---|---|---|---|---|
| JP | 2003107897 | A | | 4/2003 |
| JP | 2004139832 | A | | 5/2004 |
| JP | 2006291340 | A | | 10/2006 |
| JP | 2009010407 | A | | 1/2009 |
| JP | 2012-244131 | | * | 12/2012 |
| JP | 2013227630 | A | | 11/2013 |
| WO | 2014/178396 | A1 | | 11/2014 |

OTHER PUBLICATIONS

Extended European Search Report for EP 16 85 0908 dated May 24, 2019 including document corresponding to English translation of JP2004139832A (reference D2) annexed thereto (18 pages).

* cited by examiner

CONDUCTIVE MEMBER, AND PRODUCTION METHOD THEREFOR

TECHNICAL FIELD

The present invention relates to a conductive member, and a production method therefor.

BACKGROUND

Copper with good conductivity has conventionally been used for the substrate of conductive members such as busbars. Recently, aluminum or aluminum alloys are often used for various reasons, such as soaring copper prices. However, films of insulating oxides and hydrates easily form on the surface of aluminum or aluminum alloys, and an increase in contact resistance over time has been a problem. Thus, to improve conductivity for a conductive member using a substrate comprising aluminum or an aluminum alloy, a Sn plating layer is provided on contact parts for conducting electricity to members to be conducted.

Aluminum or aluminum alloys are materials that are difficult to plate when a Sn plating layer is provided, and thus, the surface thereof is first zincate-processed and a Zn layer is provided. The Zn layer may dissolve in some cases due to a Sn plating bath, which is a strong acidic bath. Thus, a Ni plating layer formable by a weak acidic bath is usually further provided as an underlayer on the Zn layer, and a Sn plating layer is provided on the Ni plating layer (Patent Documents 1 and 2).

[Patent Document 1] JP 2013-227630 A

[Patent Document 2] JP 2006-291340 A

SUMMARY OF INVENTION

However, the costs incurred for numerous plating steps when a Sn plating layer is provided after a Ni plating layer has been a problem. In addition, after being provided with plating layers, the surface of conductive members, aside from the contact parts thereof, were often coated with an insulating resin and the like for the purpose of preventing the conduction of electricity at parts aside from the contact parts. When integrally forming a conductive member with a resin to perform coating of the conductive member with the resin, the heat from a resin that has melted raises the temperature not only for the surfaces other than the contact parts to be coated with the resin, but also the contact parts provided with a Sn plating layer. Then, the Sn plating layer would partially melt due to Sn having a low melting point of 232° C. and would cause plating defects, meaning the effect of suppressing an increase in contact resistance may not be sufficiently obtained.

For the purpose of solving such problems, a conductive member is contemplated in which a Ni plating layer with a high melting point is the outermost surface layer instead of the underlayer, without providing a Sn plating layer. However, the Ni plating layer has a greater tendency to form oxides and hydrates than the Sn plating layer under high-temperature, high-humidity environments, and consequently, contact resistance may increase. For this reason, conductive members having a Ni plating layer and a Sn plating layer on the substrate thereof, provided in this order, continue to be used as conductive members for busbars and the like used under high-temperature, high-humidity environments, such as vehicle engine rooms. A conductive member capable of solving the problems indicated above is desirable.

The present invention addresses the problem of providing a conductive member capable of suppressing an increase in contact resistance, and a production method therefor.

The present inventors conducted various research to solve the problem indicated above, and discovered that roughening the surface of the Ni plating layer can prevent the formation of oxides and hydrates on the surface of the Ni plating layer, even under high-temperature, high-humidity environments. In addition, the preset inventors found that an increase in contact resistance is sufficiently suppressed without providing a Sn plating layer by forming a Ni plating layer with a rough surface as the outermost surface layer, thus completing the present invention.

In other words, the present invention is a conductive member having a Ni plating layer on the surface of contact parts provided on the substrate, an arithmetic average roughness Sa of the surface of the Ni plating layer being 20 nm or more.

In the present invention, regarding the Ni plating layer, the full width half maximum of a peak at the position of a Ni (200) plane in an x-ray diffraction diagram is preferably 0.6° or less.

In the present invention, an indentation hardness $H_{IT}$ of the Ni plating layer is preferably 5000 N/mm$^2$ or less.

In the present invention, the sulfur content in the Ni plating layer is preferably under 0.1 mass %. The present invention may be structured such that a resin layer is formed on surfaces other than the contact parts. In the present invention, the substrate preferably comprises aluminum or an aluminum alloy.

The present invention is a production method for any one of the conductive members described above, having a step for preparing a substrate and a plating step for bringing contact parts provided on the substrate into contact with a Ni plating solution, the Ni plating solution not containing a brightener that includes sulfur.

In the plating step, electroplating is preferably performed using a sulfamic acid bath with a pH of 3.5-4.8. The step for preparing a substrate is a step for drawing out a substrate wound in a coil shape, and the production method may be configured to further have, following the plating step, a winding step for winding the plated substrate in a coil shape, and a step for cutting and shaping the substrate. Following the plating step, the production method may also have a step for providing a resin layer on portions other than the contact parts.

According to the present invention, a conductive member capable of suppressing an increase in contact resistance may be obtained.

DESCRIPTION OF EMBODIMENTS

Embodiments of the present invention are described in detail below. The present invention is not limited to the embodiments described below, and the present invention can be practiced with modifications, as appropriate, and within a scope that does not inhibit the effects of the present invention.

Conductive Member

Figure 1:
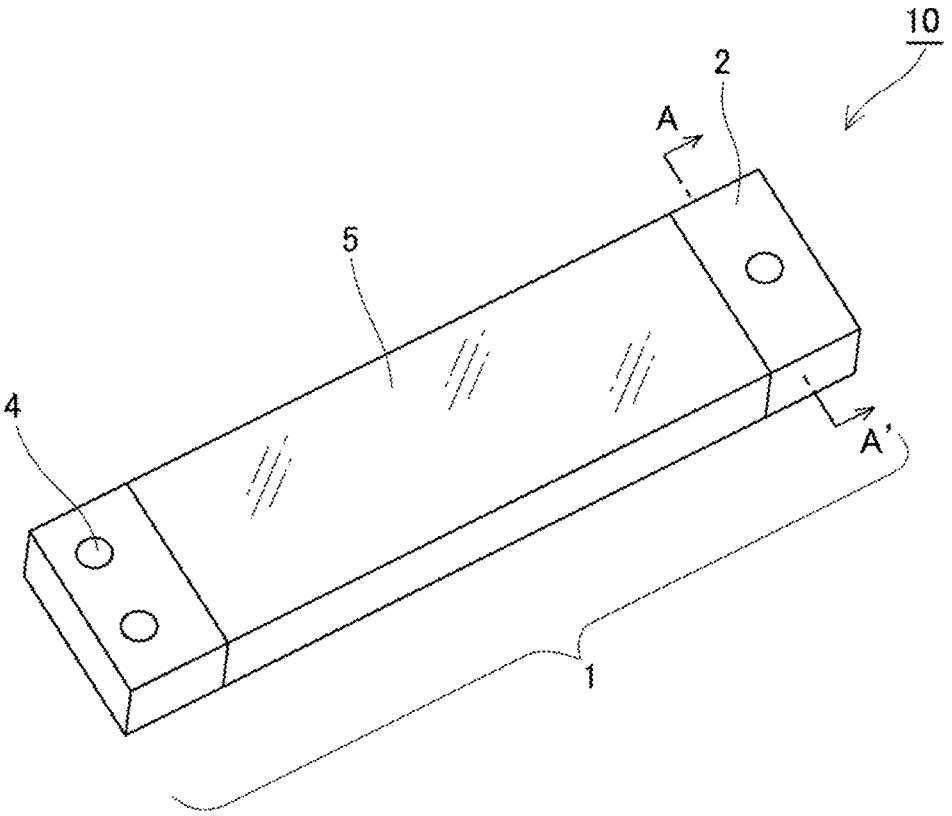
FIG. 1 is a perspective view showing an example of a conductive member.
Figure 2:
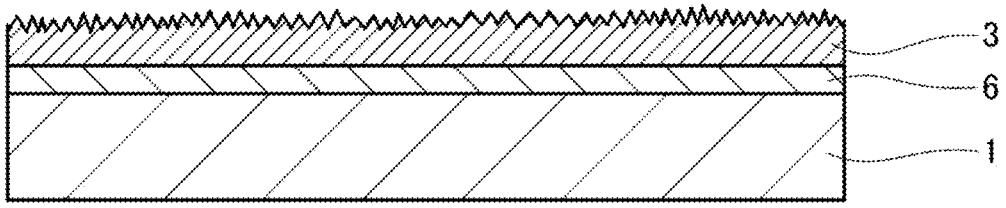
FIG. 2 is a cross-sectional view of FIG. 1 taken along the line A-A'.

A conductive member 10 according to the present invention has a Ni plating layer 3 on the surface of contact parts 2 provided on a substrate 1, as shown in FIGS. 1 and 2.

Substrate 1

The substrate 1 is not particularly limited, but for example, copper or a copper alloy, or, aluminum or an aluminum alloy, and the like may be used. Among the examples, a substrate comprising aluminum or an aluminum alloy is preferable in terms of keeping the cost low. The thickness of the substrate 1 is not particularly limited, and may be 0.1 mm or more, preferably 1 mm or more; and 50 mm or less, preferably 20 mm or less.

On the substrate 1, contact parts 2 are provided for conducting electricity to a member to be conducted. If the conductive member 10 is used as a busbar, the contact parts 2 may have one or a plurality of through-holes 4 for joining the conductive member 10 to a member to be conducted with bolts and the like.

If the substrate 1 comprises aluminum or an aluminum alloy, the substrate 1 is often zincate-processed and a Zn layer 6 is provided before the Ni plating layer 3 is provided, which will be described later in more detail. In this case, regarding the conductive member 10, the substrate 1, Zn layer 6, and Ni plating layer 3 are laminated in this order, as shown in FIG. 2. The thickness of the Zn layer 6 is not particularly limited, and may for example be 0.01-1 μm.

Ni Plating Layer 3

The Ni plating layer 3 is provided on the surface of the contact parts 2. Because Ni has a melting point of about 1450° C., which is far higher than the melting point of Sn (232° C.), defects in the Ni plating layer 3 do not occur due to the heat from a resin that has melted, even when a resin layer 5 is provided as an insulation coating film on the surface of the conductive member 10 after plating. To sufficiently coat the surface of the substrate, the thickness of the Ni plating layer is preferably 0.1 μm or more, more preferably 0.5 μm or more. In addition, when press-molding after plating, if the Ni plating is a thick film, the Ni plating tends to break without following the deformation of the substrate, and thus, from a moldability perspective, the thickness is preferably 10 μm or less, more preferably 5 μm or less.

Arithmetic Average Roughness Sa of Surface

Figure 10:
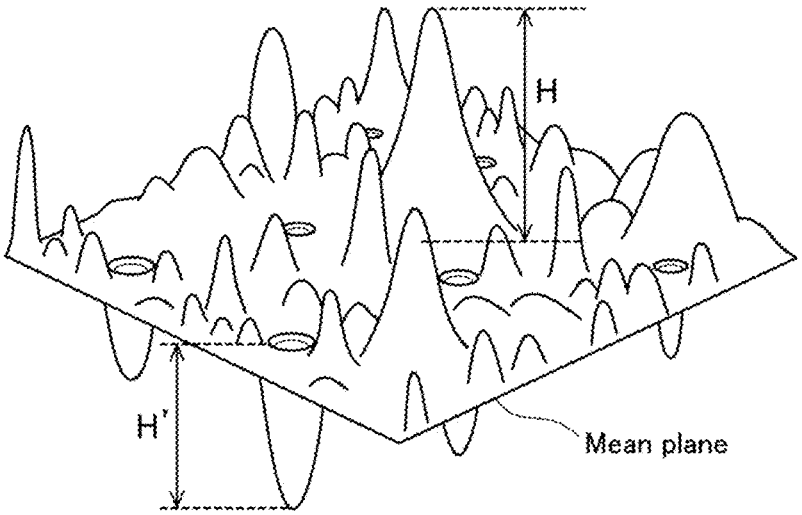
FIG. 10 is an explanatory diagram regarding the arithmetic roughness Sa of a plane.

The surface of the Ni plating layer 3 has an arithmetic average roughness Sa (hereinafter may simply be referred to as "average roughness Sa") of 20 nm or more, preferably 40 nm or more, more preferably 150 nm or more. The arithmetic average roughness Sa of a plane is a parameter extending the arithmetic average roughness Ra of a line to the plane, and represents the average value calculated from the absolute values of the difference in heights H, H' of each point with respect to a mean plane, as shown in FIG. 10, using a light interference microscope. Measurement may be performed in compliance with ISO 25178.

Because the average roughness Sa of the Ni plating layer 3 is 20 nm or more, the surface of the layer is rough. Ni plating layers were conventionally preferably formed to be smooth and uniform when used as the outermost surface layer for the purpose of improving visual appearance or preventing blemishes. However, the present inventors found through intensive research that, conversely, the greater the surface roughness of the plating layer, the less increase in contact resistance over time when used under high-temperature, high-humidity environments. As demonstrated in the examples that will be described later in more detail, an increase in contact resistance over time of conductive members under a high-temperature, high-humidity environment was suppressed when the arithmetic average roughness Sa of the surface of the Ni plating layer 3 was 20 nm or more. Because the Ni plating layer 3 may be the outermost surface layer of the conductive member, a Sn plating layer need not be further provided on the Ni plating layer, as in the prior art, and costs can also be suppressed.

The upper limit of the arithmetic average roughness Sa of the surface of the Ni plating layer 3 is not limited, since the greater the average roughness Sa, the better, but if the roughness is greater than the plating film thickness, then the recessed parts would reach the substrate and thus result in a defect of the coating layer. Thus, from the perspective of ensuring sufficient coatability, the upper limit may be less than or equal to the plating film thickness, preferably half or less of the plating film thickness.

Full Width Half Maximum of X-ray Diffraction Peak

Figure 4:
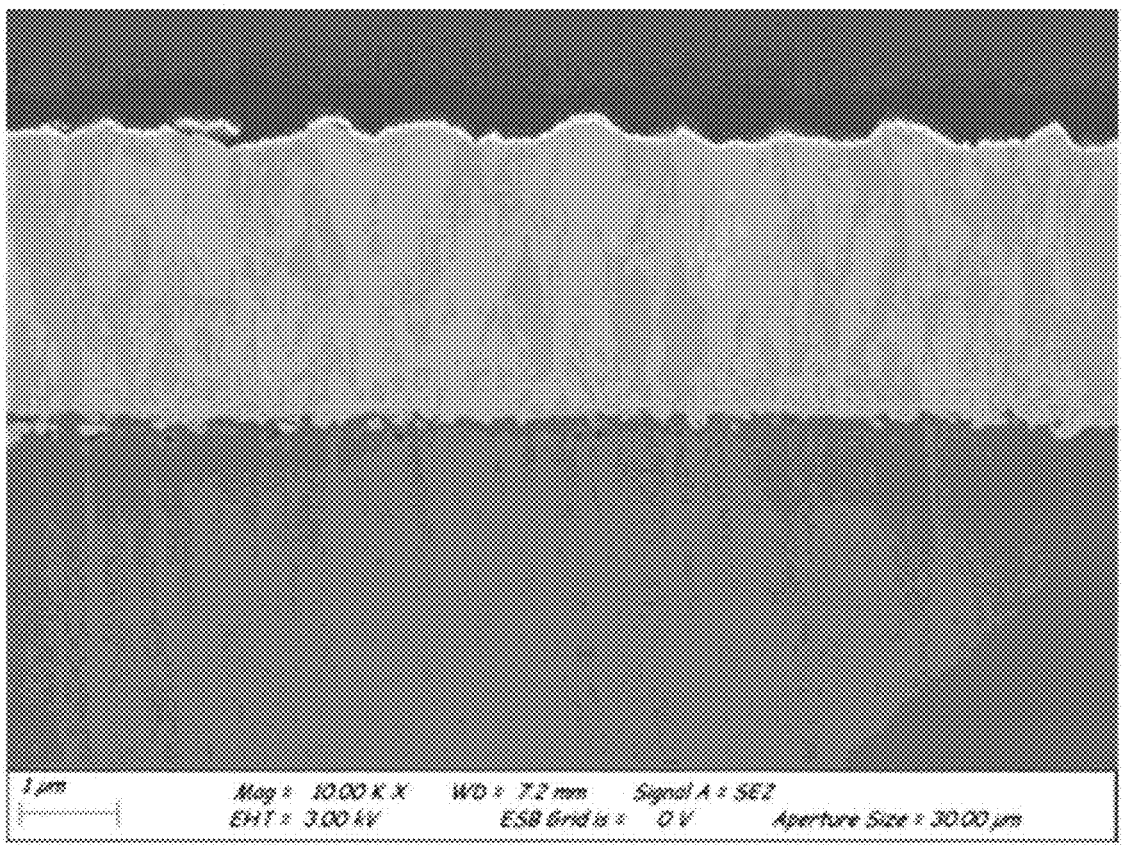
FIG. 4 is a scanning electron microscope image of the surface of a Ni plating layer formed by a plating solution that does not contain a brightener.

One of the factors contributing to the surface roughness of the Ni plating layer 3 is the crystal grain size of the Ni plating layer 3. That is, the greater the size of the crystal grains constituting the Ni plating layer 3, the easier it is for the surface roughness to be greater (rougher), as shown in FIG. 4. In this case, the crystal grain size is determined by the Scherrer equation shown in formula (1) below. In other words, because the crystal grain size is proportional to the reciprocal of the full width half maximum of a peak in the x-ray diffraction, the crystallinity of the plating can be quantified by measuring the full width half maximum of the peak by means of x-ray diffraction.

Equation 1

$$D = \frac{K \cdot \lambda}{\beta \cdot \cos\theta} \tag{1}$$

(where D: crystallite size (nm); β: full width half maximum (°); θ: Bragg angle of diffracted x-ray; λ: wavelength of measured x-ray (nm); K: constant 0.94)

Figure 11:
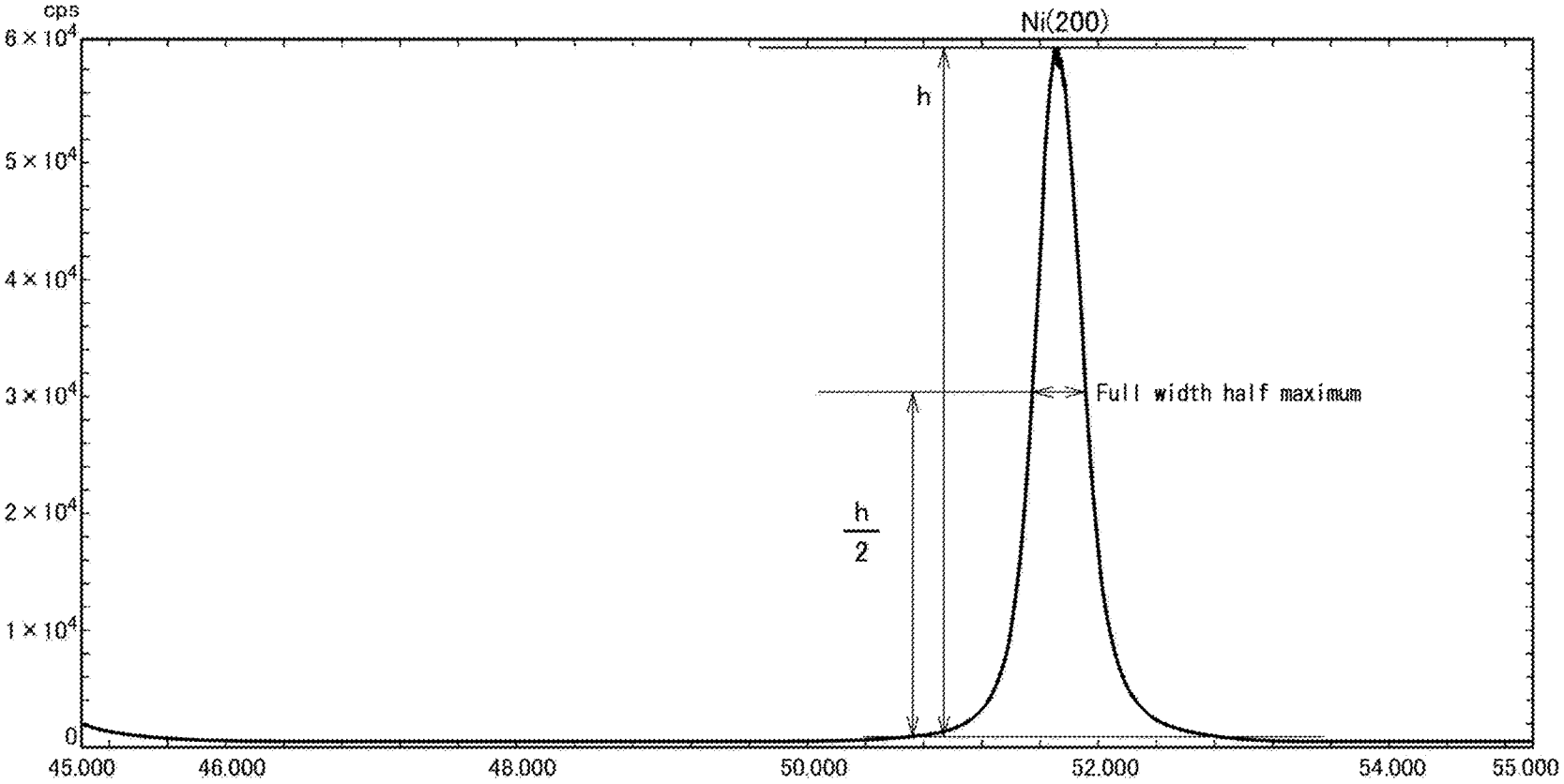
FIG. 11 is an explanatory diagram regarding the full width half maximum of an x-ray diffraction peak.

Thus, in the present invention, the crystal grain size of the plating layer is preferably defined such that the Ni plating layer 3, as shown in FIG. 11, has a peak at the position of the Ni (200) plane in an x-ray diffraction diagram, and the full width half maximum of the peak is 0.6° or less. In addition, the Ni (200) plane is a diffraction peak at the (200) plane in a Miller index representation in an x-ray diffraction using CuKα radiation. The Ni (200) plane differs depending on the measurement equipment and measurement conditions, but for example, in a chart obtained through x-ray diffraction, a diffraction peak in which 2θ appears at 51.8±1° may be used. The full width half maximum of the peak is more preferably 0.5° or less, even more preferably 0.4° or less. A peak full width half maximum that is 0.6° or less increases the crystal grain size, and increases the surface roughness Sa. Consequently, an increase in contact resistance over time can be further suppressed, particularly under high-temperature, high-humidity environments. The lower limit of the peak full width half maximum is not particularly limited, and may be 0.1° or more. In FIG. 11, "h" shows the height (intensity) of the peak at the position of the Ni (200) plane.

In addition, the x-ray diffraction measures a diffraction angle 2θ from 10° to 80° using CuKα radiation as the x-ray source, and the tube voltage is set to 50 kV, the tube electric current is set to 200 mA, and the scan rate is set to 1°/min.

Indentation Hardness $H_{IT}$

The indentation hardness $H_{IT}$ of the Ni plating layer 3 is preferably 5000 N/mm$^2$ or less. With an indentation hardness $H_{IT}$ of 5000 N/mm$^2$ or less, the protruding parts (newly produced Ni surface) are crushed and deformed when the conductive member 10 is fastened to a member to be conducted, and the contact area between a joining part 2 of the conductive member 10 and a joining part of the member to be conducted increases. Consequently, contact resistance can be reduced. Specifically, an area (actual contact area) Ar, which indicates the area where two solid bodies are in contact with each other through their surfaces, is represented by formula (2) below.

$$Ar=P/pm \quad (2)$$

(where P: load, pm: yield stress of softer material)

As is clear from formula (2) above, the lower the hardness of the plating (the lower the yield stress Pm of the softer material), the greater the actual contact area Ar, which may facilitate the establishment of electrical contact.

The lower limit of the indentation hardness $H_{IT}$ is not particularly limited, and may be 100 N/mm$^2$ or more. Generally, the Vickers hardness test and the like are used for quantitative evaluation of hardness, but because the Ni plating layer 3 is thin, as in a thickness of around several μm, with a micro Vickers test the indentation depth would reach the substrate 1 and the measurement results may be affected by the hardness of the substrate 1. For this reason, in this case the indentation hardness $H_{IT}$ is an indentation hardness measured using a nanoindenter.

Formation Method for Ni Plating Layer 3

The formation method for the Ni plating layer 3 is not particularly limited. The Ni plating layer 3 may be formed by electroplating or electroless plating, but electroplating is preferred for facilitating the formation of a plating layer having a rough surface. Pretreatment such as degreasing, pickling, and water washing may be performed as needed before the Ni plating layer 3 is formed. For the Ni plating solution, industrial plating solutions such as those for Watts baths and sulfamic acid baths may be used. Among such plating solutions, those in a sulfamic acid bath with a pH of 3.5-4.8 are preferable from the perspective of preventing the Zn layer, if provided on the substrate 1, from melting, as well as having small internal stress and excellent moldability after plating.

Figure 3:
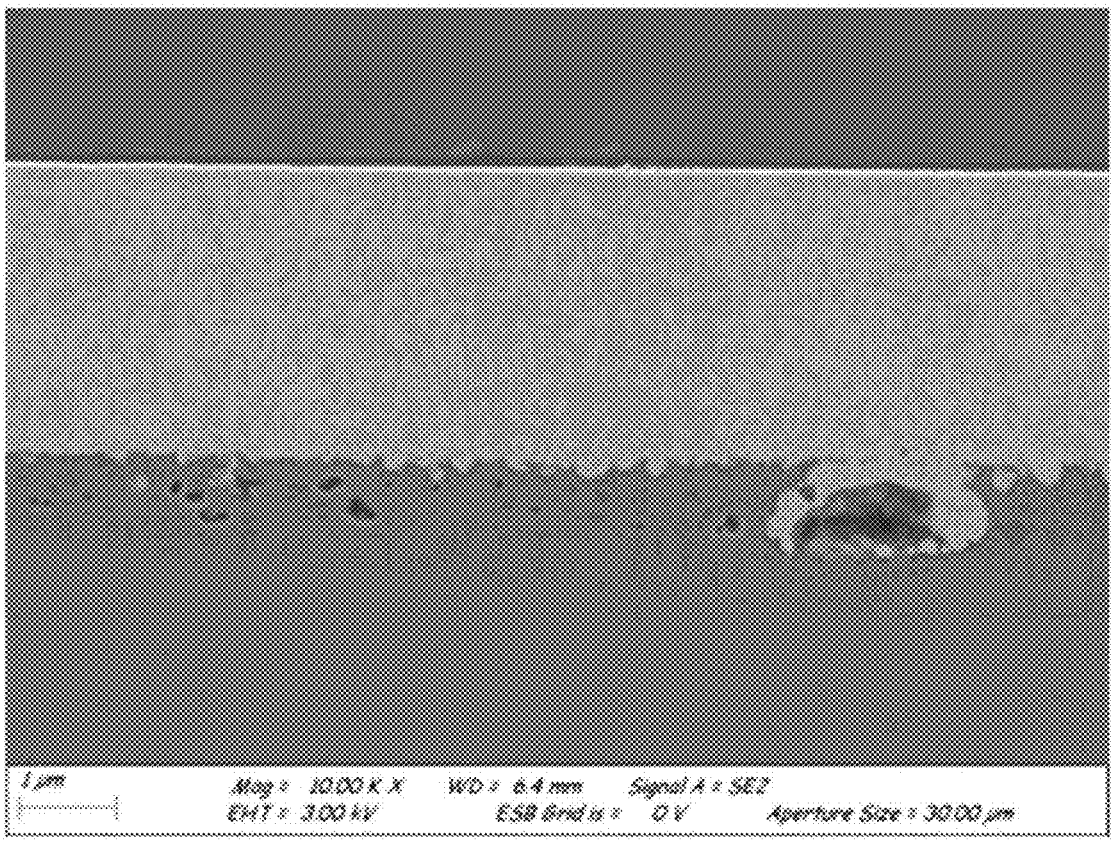
FIG. 3 is a scanning electron microscope image of the surface of a Ni plating layer formed by a plating solution containing a brightener that includes sulfur.

Generally, a brightener is added to a Ni plating solution to give the resulting Ni plating layer a gloss finish. Brighteners that include sulfur, such as saccharin, are often used. Brighteners that include sulfur exhibit the function of reducing the grain size of crystals constituting the plating layer. For example, FIG. 3 shows a scanning electron microscope (SEM) image of the surface of a Ni plating layer formed by a plating solution containing a brightener that includes sulfur. The crystal grains of the surface of the Ni plating layer are fine, and crystal grains cannot be seen with the SEM image. Consequently, the surface of the Ni plating layer is smooth. On the other hand, FIG. 4 shows a scanning electron microscope image of the surface of a Ni plating layer formed by a plating solution that does not contain a brightener (matte plating). Coarse Ni crystal grains on the order of several 100 nm can be seen on the surface of the Ni plating layer. Consequently, the surface of the Ni plating layer is rough.

Thus, the plating solution preferably does not contain a brightener that includes sulfur to obtain a Ni plating layer 3 having a large crystal grain size and a rough surface. The crystal grain size of the Ni plating layer 3 may be increased by, for example, not including a brightener or including a brightener that does not contain sulfur in the plating solution. Consequently, by making the surface of the Ni plating layer 3 rough, the formation of oxides and hydrates can be suppressed, even under high-temperature, high-humidity environments, and an increase in contact resistance over time can be suppressed.

In this case, the formed Ni plating layer 3 substantially does not contain sulfur. The sulfur content in the Ni plating layer is for example under 0.1 mass %, preferably under 0.05 mass %.

A Ni plating layer 3 with a large crystal grain size can be formed by other methods. For example, the current density during plating can be kept low at 2-10 A/dm$^2$, preferably 2-5 A/dm$^2$; and to increase the Ni ion concentration in the plating bath, for example in the case of a sulfamic acid Ni plating bath, the concentration of nickel sulfamate in the treatment solution can be increased to 400-500 g/L, preferably 450-500 g/L.

Meanwhile, following the formation of the Ni plating layer 3, a surface roughness Sa of 20 nm or more can mechanically be achieved by sandblasting, filing, and the like. In this case, the Ni plating layer 3 may be formed regardless of the crystal grain size and then the surface mechanically roughened.

Resin Layer 5

Regarding the conductive member 10, the resin layer 5 may be formed as an insulation film on surfaces other than the contact parts 2. Conduction of electricity at portions other than the contact parts can be prevented by providing the resin layer 5. The resin forming the resin layer 5 is not particularly limited so long as the resin can be coated on the substrate 1. For example, a thermoplastic resin may be used. One or two or more thermoplastic resins selected from general purpose plastic, general purpose engineering plastic, super engineering plastic and the like may be used. Examples of the general purpose plastic include polypropylene and ABS resin. Examples of the general purpose engineering plastic include polyamides, polycarbonates, and polybutylene terephthalate. Examples of the super engineering plastic include polyphenylene sulfide and polyamide-imides. The thickness of the resin layer is not particularly limited, and may be 10-5000 μm.

The formation method for the resin layer 5 is not particularly limited. For example, following the formation of the plating layer 3 on the substrate, the resin layer 5 may be integrally formed with the substrate 1 by means of injection molding, melt extrusion molding, compression molding, transfer molding and the like. Because the Ni plating layer 3 provided on the surface of the contact parts 2 on the substrate 1 has a high melting point, defects in the Ni plating layer 3 caused by melting do not occur due to the heat from a resin that has melted. Consequently, even when the resin layer 5 is provided on the conductive member 10 and the member is thus coated with insulation, the effect of suppressing an increase in contact resistance can sufficiently be obtained.

Production Method for Conductive Member 10

The production method for the conductive member 10 has a step for preparing the substrate 1 (hereinafter referred to as "substrate preparation step"), and a plating step for bringing the contact parts provided on the substrate 1 into contact with a Ni plating solution (hereinafter referred to as "plating step"), the Ni plating solution not containing a brightener that includes sulfur. Because the Ni plating solution does not contain a brightener that includes sulfur, the surface of the Ni plating layer 3 becomes rougher, allowing a conductive member 10 capable of suppressing an increase in contact resistance over time to be obtained. In addition, because the conductive member 10 unlike conventional conductive members does not have a multilayer plating layer comprising a Ni plating layer and a Sn plating layer, there are fewer plating steps. For this reason, a Ni plating layer 3 may be formed by means of the so-called coil-to-coil method, in which a substrate wound in a coil shape is unwound, plated, and then wound in a coil shape again, after which the substrate is cut and shaped to produce the conductive member 10.

Substrate Preparation Step

The substrate preparation step is a step for preparing the substrate of the conductive member, and the method thereof is not particularly limited. When plating by the coil-to-coil method indicated above, the substrate preparation step may be a step for unwinding and drawing out a substrate 1 wound in a coil shape. The drawing-out speed may be appropriately adjusted in accordance with the time and rate of the plating at the Ni plating step. The substrate 1 preferably comprises aluminum or an aluminum alloy to keep the cost low. When the substrate 1 comprises aluminum or an aluminum alloy, the substrate preparation step may have a step for zincate-processing the substrate 1 to form a Zn layer 6 on the substrate 1.

Ni Plating Step

The Ni plating step is a step for bringing the substrate 1 into contact with a Ni plating solution to form a Ni plating layer 3 on the substrate 1. The Ni plating method and plating solution are as described above. The plating step may have a pretreatment step for performing pretreatment such as degreasing, pickling, and washing, as needed. The Ni plating solution preferably does not contain a brightener that includes sulfur for the purpose of making the size of the formed crystal grains larger and setting the surface roughness Sa of the Ni plating layer 3 to 20 nm or more. Examples of brighteners containing sulfur include saccharin, trisodium 1,3,6-naphthalenetrisulfonate, and naphthalene-1,3,6-trisulfonic acid sodium salt. Preferably, the plating solution does not contain a brightener or contains a brightener that does not include sulfur. Examples of brighteners that do not contain sulfur include brighteners categorized as secondary brighteners. Examples of brighteners categorized as secondary brighteners include, for example, coumarin, 2-butyne-1,4-diol, ethylene cyanohydrin, propargyl alcohol, formaldehyde, quinoline, and pyridine.

In the plating step, electroplating is preferably performed using a sulfamic acid bath with a pH of 3.5-4.8 or a Watts bath with a pH of 4.0-5.5, but as described above, a sulfamic acid bath is more preferable because of excellent moldability following plating. The current density is preferably 2-10 $A/dm^2$ when forming the Ni plating layer by the electroplating process. A more preferable current density is 2-5 $A/dm^2$. Furthermore, to increase the Ni ion concentration in the Ni plating solution, in the case of for example a sulfamic Ni plating bath, the nickel sulfamate concentration in the plating solution may be 400-500 g/L, or preferably 450-500 g/L.

In addition, if the plating step is performed by the coil-to-coil method, then following the plating step, the production method may have a step for winding the substrate 1 in a coil shape (hereinafter simply referred to as "winding step"), and a step for cutting and shaping (hereinafter simply referred to as "processing step"). Furthermore, when insulation-coating surfaces other than the contact parts, the production method may have a step for forming a resin layer on surfaces other than the contact parts (hereinafter referred to as "resin layer formation step").

Production costs may be lowered when the Ni plating is performed before the processing step, compared to when the Ni plating is performed after the processing step. As such, the production method preferably has the substrate preparation step, Ni plating step, winding step, and processing step in this order. The production method preferably has the resin layer formation step after the processing step. In addition, because a step for forming a Sn plating layer is not required, the conductive member 10 may be produced with a minimum number of steps comprising the substrate preparation step, Ni plating step, winding step, processing step, and resin layer formation step to keep the cost low.

Winding Step

The winding step is a step for winding a Ni-plated substrate in a coil shape again. The winding speed may be appropriately adjusted in accordance with the time and rate of the plating at the Ni plating step. Unlike conventional conductive members, the formation of a multilayer plating layer comprising a Ni plating layer and a Sn plating layer is not required, meaning there are fewer plating steps. In this manner, the Ni plating layer 3 may be formed by the so-called coil-to-coil method, in which a substrate in a coil shape is wound in a coil shape again after being plated.

Processing Step

The step for cutting and shaping is a step for cutting the substrate 1, on which the Ni plating layer 3 is formed, to a desired size and then shaping to a desired shape to obtain the conductive member 10. At this step, the cutting and shaping may be performed as separate steps, or may be performed simultaneously, as is the case with pressing.

Resin Layer Formation Step

The resin layer formation step is a step for providing the resin layer 5 on surfaces other than the contact parts 2 to insulate and coat the surfaces. Because the conductive member 10 has the Ni plating layer 3 on the surface of the contact parts 2, plating defects do not occur, even when the contact parts 2 reach high temperatures due to the heat from a resin that has melted when forming the resin layer, allowing the effect of suppressing an increase in contact resistance to sufficiently be obtained. The resin used and the formation method are as described above.

EXAMPLES

The present invention will be described in greater detail with examples shown below, and the interpretation of the present invention is not to be limited by the examples.

Example 1

A rolled product of aluminum alloy 6101-T6 material (100 mm×200 mm×thickness 3 mm) was used as the substrate 1. As indicated below, on both sides of the substrate 1, (1) alkali etching and desmutting and (2) a two-step zincate treatment were performed as pretreatments, then (3) electro-Ni plating was performed to form a Ni plating layer 3, and a conductive member 10 of example 1 was obtained.

The (1) alkali etching and desmutting were performed as described below. That is, the substrate 1 was alkali-etched by being immersed in 50 g/L of a NaOH aqueous solution at 50° C. for 30 seconds, and then washed with room-temperature tap water for 30 seconds. Thereafter, the substrate 1 was immersed in a desmutting solution, in which 60 mass % of nitric acid was diluted to a concentration of 500 ml/L with ion-exchanged water and kept at room temperature, for 30 seconds and further washed with room-temperature tap water for 30 seconds.

The (2) two-step zincate treatment was performed as described below. That is, zincate solution "Substar-ZN-111", produced by Okuno Chemical Industries Co., Ltd., was diluted to a concentration of 500 ml/L with ion-exchanged water, and after the substrate 1 was desmutted, the substrate 1 was immersed for 60 seconds in the zincate solution that was kept at room temperature. After the substrate 1 was washed with room-temperature tap water for 30 seconds, the substrate 1 was immersed in a zinc stripping solution, in which 60 mass % of nitric acid was diluted to a concentration of 100 ml/L with ion-exchanged water and kept at room temperature, for 30 seconds and the zinc layer was stripped off. After the substrate 1 was further washed, the substrate 1 was immersed in the zincate solution described above for 30 seconds, and a dense zinc substituted layer was formed on the substrate. This was then washed, resulting in a pretreatment material.

The (3) electro-Ni plating was performed as described below using a Watts bath. That is, a plating bath (Watts bath) containing 240 g/L of nickel sulfate hexahydrate and 35 g/L of boric acid was kept at a bath temperature of 45° C., then the pretreatment material was immersed therein as a cathode, plated at a cathode current density of 4 A/dm$^2$, and a Ni plating layer 3 was formed. The plating time may be any given time allowing the thickness of the Ni plating layer 3 to be around 3 μm.

Example 2

The conductive member 10 of example 2 was obtained in a similar manner as example 1, except that a Ni plating layer 3 was formed using a sulfamic acid bath as described below. The Ni plating layer 3 was plated and formed in a plating bath (sulfamic acid bath) containing 450 g/L of nickel sulfamate tetrahydrate, 10 g/L of nickel chloride hexahydrate, and 35 g/L of boric acid at a cathode current density of 5 A/dm$^2$.

Example 3

The conductive member 10 of example 3 was obtained in a similar manner as example 2, except that SN-20 produced by Murata Co., Ltd. was added to a sulfamic acid bath at a concentration of 4 ml/L as a brightener that does not include sulfur.

Comparative Example 1

The conductive member of comparative example 1 was obtained in a similar manner as example 1, except that saccharin was added to a Watts bath at a concentration of 3 g/L as a brightener.

Comparative Example 2

The conductive member of comparative example 2 was obtained in a similar manner as example 2, except that saccharin was added to a sulfamic acid bath at a concentration of 3 g/L as a brightener.

All of the plating baths in the examples and comparative examples described above had a pH of 4.0.

Arithmetic Average Roughness Sa

Samples after the formation of the Ni plating layer were cut into a 20-millimeter square, and using a light interference microscope (GT-1) manufactured by Bruker AXS, Inc., a field of view of approximately 20 μm×40 μm was selected from the surface of the samples with an objective lens magnification of 115×. The arithmetic average roughness Sa of the plane in the field of view for measurement was calculated according to ISO 25178, and used as the arithmetic average roughness Sa of the surface of the Ni plating layer. The results are shown in table 1.

Full Width Half Maximum of Peak in X-ray Diffraction Diagram

Regarding the samples after the formation of the Ni plating layer, the average value of the full width half maximum of the peak at the position of the Ni (200) plane was calculated by measuring the x-ray diffraction of the Ni plating layer three times under the conditions described below, using an x-ray diffractometer RAD-rR manufactured by Rigaku Corporation. The diffraction angle 2θ was 51.8° when the calculation was performed. The results are shown in table 1.

Tube bulb: Cu

Radiation source: CuKα radiation

Tube voltage: 50 kV

Tube current: 200 mA

Monochromator used (monochromator light-receiving slit: 0.8 mm)

Goniometer radius: 185 mm

Sampling width: 0.01°

Scan rate: 1°/min

Divergence slit: 1°

Scattering slit: 1°

Light-receiving slit: 0.3 mm

Attachment: ASC-43 (horizontal type)

Rotation speed: 80 rpm

Indentation Hardness $H_{IT}$

Samples after the formation of the Ni plating layer were cut into a 20-millimeter square, and using a nanoindenter ENT-1100a manufactured by Elionix Inc., Berkovich-type diamond indenter code 6170 was pressed into the samples under a load of 20 mN, and the indentation hardness $H_{IT}$ defined by ISO 14577 was calculated. The results are shown in table 1.

Contact Resistance Measurement

Samples after the formation of the Ni plating layer were washed with room-temperature ion-exchanged water for 30 seconds and hot-air dried using a dryer, and then the contact resistance of the samples were measured. Thereafter, the samples were subjected to a hygrothermal cycling test, and then the contact resistance of the samples was measured again.

Figure 5:
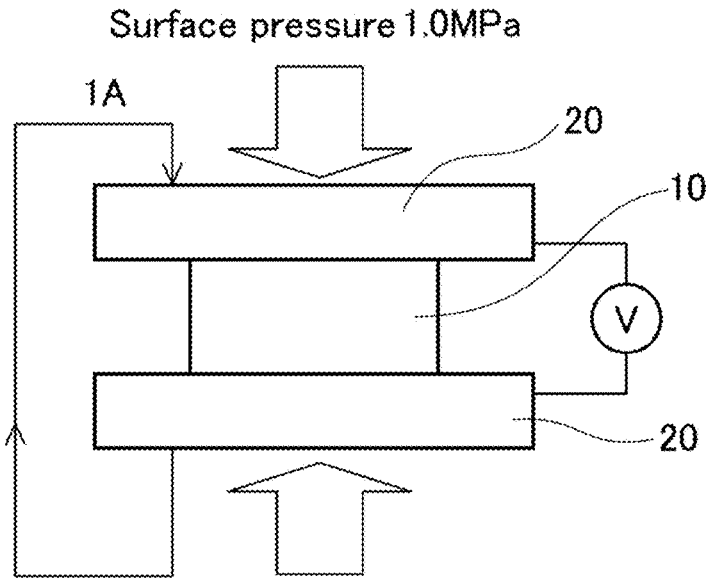
FIG. 5 is a schematic diagram showing a measurement method for contact resistance.

The contact resistance is calculated from R=(V/I)×S by sandwiching a sample between Au-plated Al sheets 20, supplying 1A of electric current while applying a surface pressure of 1 MPa, and measuring a voltage drop V between the Au-plated sheets, as shown in FIG. 5. In R=(V/I)×S, R: contact resistance (mΩcm$^2$), I: electric current (A), and S: contact area 2×2 (cm$^2$).

Figure 6:
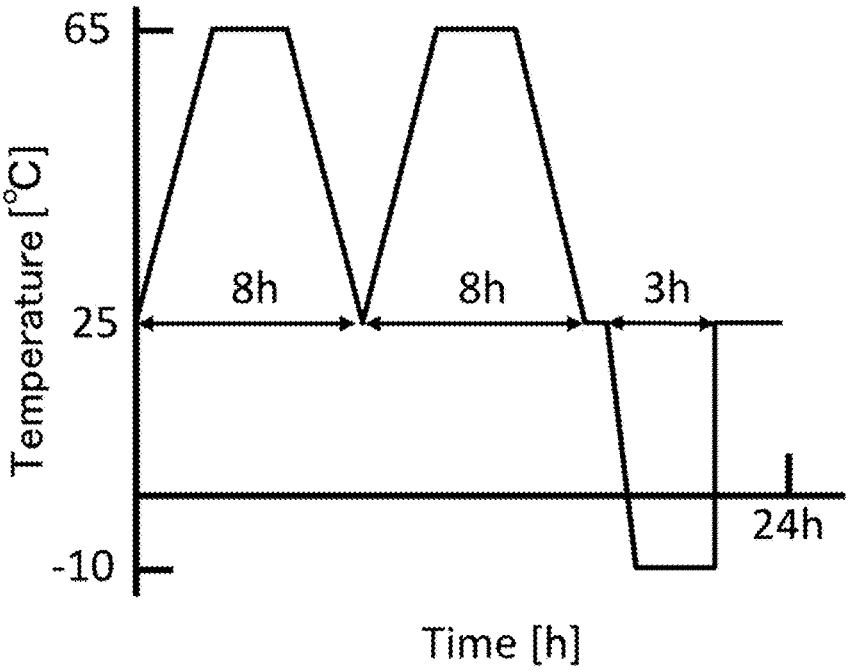
FIG. 6 is an explanatory diagram regarding a hygrothermal cycling test.

The hygrothermal cycling test was performed in line with the cycle schematic diagram of the hygrothermal cycling test shown in FIG. 6 for 10 cycles according to JIS C 60068-2-38 (test code: Z/AD) at 93% humidity, using a thermo-hygrostat PR-4J manufactured by Espec Corp. That is, the temperature was raised from 25° C. to 65° C. over two hours, and after the temperature of 65° C. was maintained for 3.5 hours, the temperature was lowered from 65° C. to 25° C. over two hours. The temperature of 25° C. was further maintained for 0.5 hours, and this cycle was repeated twice. Thereafter, the temperature was lowered from 25° C. to −10° C. over 0.5 hours, and after the temperature of −10° C. was maintained for three hours, the temperature was raised from −10° C. to 25° C. over 1.5 hours, and then the temperature of 25° C. was maintained until 24 hours after initiation of the test. The results are shown in table 1.

It is indicated that an increase in the contact resistance value is suppressed when the contact resistance value after the hygrothermal cycling test is below 3 mΩcm$^2$. On the other hand, it is indicated that that the contact resistance has increased when the contact resistance value above 3 mΩcm$^2$. As is clear from table 1, the contact resistance for the conductive members of examples 1-3 are all below 3 mΩcm$^2$, meaning an increase in the contact resistance value is suppressed.

S Content Measurement

Regarding the samples after the formation of the Ni plating layer, the sulfur content (S fraction) in the Ni plating layer was measured using an electron probe microanalyzer (EPMA; model number EPMA-1610, manufactured by Shimadzu Corporation, lower analytical limit of 0.1 mass %). The results are shown in table 1. Sulfur was not detected from the Ni plating layer of the conductive members of examples 1-3.

Table 1

TABLE 1

| | Plating solution | Half-value width (2θ °) | Sa (nm) | $H_{IT}$ (N · mm$^{-2}$) | Contact resistance (mΩcm$^2$) Before hygrothermal cycling test | Contact resistance (mΩcm$^2$) After hygrothermal cycling test | S fraction according to EPMA (mass %) |
|---|---|---|---|---|---|---|---|
| Example 1 | Watts bath (no brightener) | 0.313 | 47.5 | 4410 | 0.225 | 0.653 | <0.1 |
| Example 2 | Sulfamic acid (no brightener) | 0.376 | 182.3 | 3227 | 0.133 | 0.307 | <0.1 |
| Example 3 | Sulfamic acid (sulfur-free brightener) | 0.526 | 37.7 | 3779 | 0.287 | 2.121 | <0.1 |
| Comparative Example 1 | Watts bath (brightener) | 0.827 | 13.4 | 6655 | 0.423 | 5.843 | 0.1 |
| Comparative Example 2 | Sulfamic acid (brightener) | 0.87 | 18.8 | 7289 | 0.354 | 3.412 | 0.1 |

Figure 7:
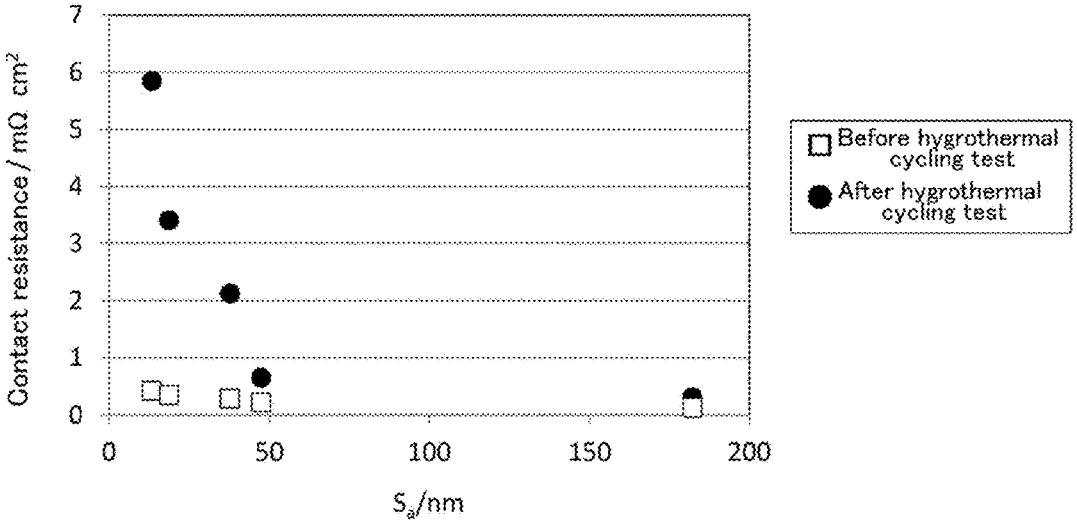
FIG. 7 is a graph showing the relationship between contact resistance and the arithmetic average roughness Sa of the Ni plating layer surface.
Figure 8:
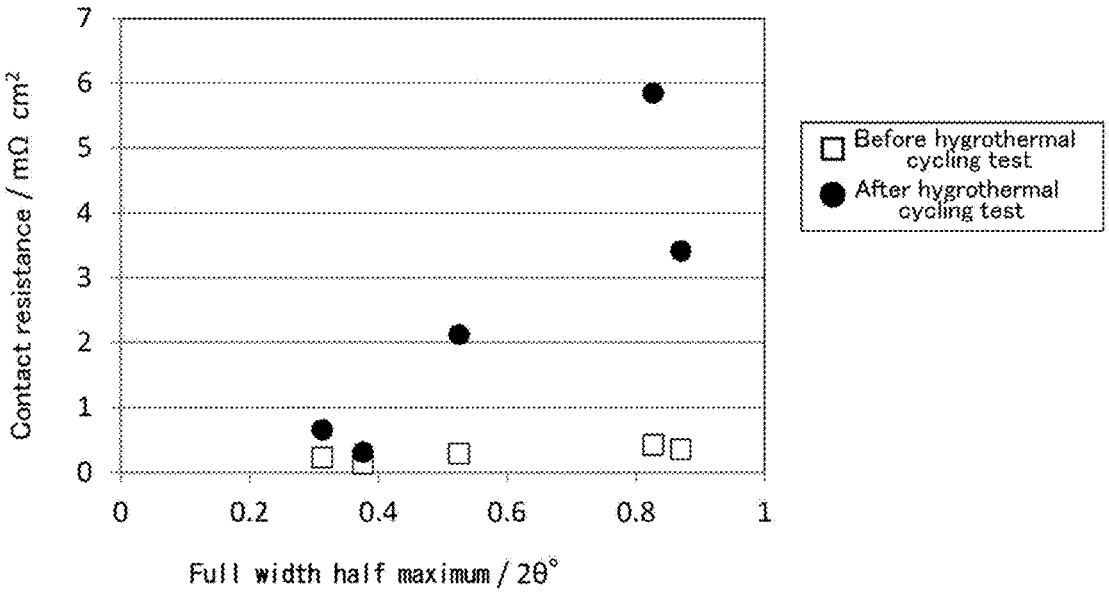
FIG. 8 is a graph showing the relationship between contact resistance and the full width half maximum of the peak in the X-ray diffraction diagram of the Ni plating layer.
Figure 9:
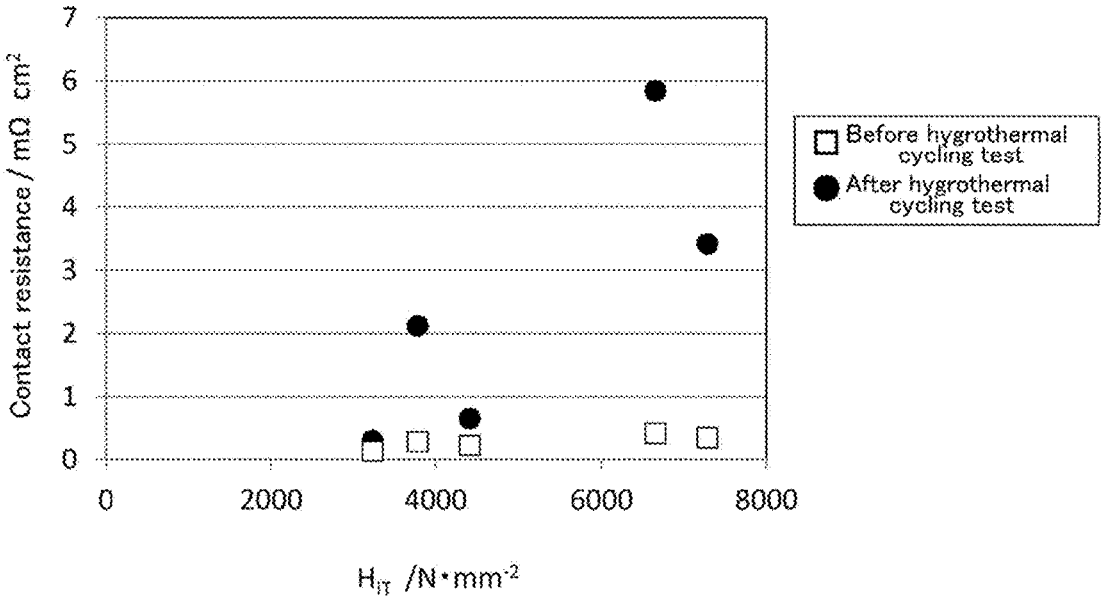
FIG. 9 is a graph showing the relationship between contact resistance and the indentation hardness $H_{IT}$ of the Ni plating layer.

FIG. 7-9 show the relationship between contact resistance and the arithmetic average roughness Sa (FIG. 7), the full width half maximum of a peak in an x-ray diffraction diagram (FIG. 8), or the indentation hardness $H_{IT}$ (FIG. 9) on the basis of the numerical values in table 1. In FIG. 7-9, the squares indicate values prior to hygrothermal cycling, and the black circles indicate values following the hygrothermal cycling test. If the contact resistance value following the hygrothermal cycling test (shown as black circles) is 3 mΩcm$^2$ or less, the suppression of an increase in contact resistance can be deemed possible even under high-temperature, high-humidity environments. As is clear from FIG. 7-9, the contact resistance following the hygrothermal cycling test was 3 mΩcm$^2$ or less for the conductive members of examples 1-3, in which the arithmetic average roughness Sa of the Ni plating layer was 20 nm or more. Thus, the conductive members of examples 1-3 suppressed an increase in contact resistance.

REFERENCE SIGNS LIST

1 Substrate
2 Contact part
3 Ni plating layer
4 Through-hole
5 Resin layer
6 Zinc layer
10 Conductive member

The invention claimed is:

1. A conductive member having a Ni plating layer on the surface of contact parts provided on a substrate of the conductive member, an arithmetic average roughness Sa of the surface of the Ni plating layer being 20 nm or more, wherein in the Ni plating layer, the full width half maximum of a peak at the position of a Ni (200) plane in an x-ray diffraction diagram is 0.6° or less.

2. The conductive member according to claim 1, wherein an indentation hardness $H_{IT}$ of the Ni plating layer is 5000 $N/mm^2$ or less. 3. The conductive member according to claim 1, wherein the content of sulfur in the Ni plating layer is under 0.1 mass%.

4. The conductive member according to claim 1, wherein a resin layer is formed on surfaces other than the contact parts.

5. The conductive member according to claim 1, wherein the substrate comprises aluminum or an aluminum alloy.

6. A production method for the conductive member according to claim 1, comprising:

a step for preparing the substrate, and a plating step for bringing the contact parts provided on the substrate into contact with a Ni plating solution, wherein the Ni plating solution does not contain a brightener that includes sulfur.

7. The production method according to claim 6, wherein electroplating is performed using a sulfamic acid bath with a pH of 3.5-4.8 in the plating step.

8. The production method according to claim 6, wherein the step for preparing the substrate is a step for drawing out a substrate wound in a coil shape, and the production method further comprises, following the plating step, a step for winding the plated substrate in a coil shape, and a step for cutting and shaping the substrate.

9. The production method according to claim 6, wherein the production method comprises, following the plating step, a step for providing a resin layer on portions other than the contact parts.

* * * * *